US006966521B2

(12) United States Patent
White

(10) Patent No.: US 6,966,521 B2
(45) Date of Patent: Nov. 22, 2005

(54) CORE POSITIONING APPARATUS

(75) Inventor: Nigel White, Pocklington (GB)

(73) Assignee: A B Graphic International Ltd., (GB)

( * ) Notice: Subject to any disclaimer, the term of this patent is extended or adjusted under 35 U.S.C. 154(b) by 0 days.

(21) Appl. No.: 10/247,871

(22) Filed: Sep. 20, 2002

(65) Prior Publication Data

US 2003/0057314 A1 Mar. 27, 2003

(30) Foreign Application Priority Data

Sep. 21, 2001 (GB) ..... 0122783

(51) Int. Cl.[7] ..... B65H 19/30
(52) U.S. Cl. ..... 242/533.7; 242/533.2; 242/533.4; 242/554
(58) Field of Search ..... 242/533.7, 533.4, 242/533.2, 554; 414/27, 908, 910

(56) References Cited

U.S. PATENT DOCUMENTS

| | | | | |
|---|---|---|---|---|
| 2,913,098 A | | 11/1959 | Zellinsky et al. | |
| 3,733,035 A | * | 5/1973 | Schott, jr. | 242/527.3 |
| 3,946,884 A | * | 3/1976 | Kato et al. | 414/800 |
| 4,208,019 A | * | 6/1980 | Dusenbery | 242/527.2 |
| 5,433,572 A | * | 7/1995 | Swain et al. | 414/27 |
| 5,460,477 A | * | 10/1995 | Macchiarulo et al. | 414/801 |
| 5,941,474 A | | 8/1999 | Cushing | |
| 6,269,859 B1 | * | 8/2001 | Semba | 156/457 |

FOREIGN PATENT DOCUMENTS

| | | | |
|---|---|---|---|
| EP | 0 306 092 A1 | 3/1989 | |
| GB | 886774 | 1/1962 | |
| GB | 1324183 | 7/1973 | |
| JP | 59190119 A * | 10/1984 | B65G 57/16 |

OTHER PUBLICATIONS

Search Report dated Feb. 12, 2003 issued in corresponding EP application EP 02 25 6560.

* cited by examiner

*Primary Examiner*—Kathy Matecki
*Assistant Examiner*—Sang Kim
(74) *Attorney, Agent, or Firm*—Fay, Sharpe, Fagan, Minnich & McKee, LLP

(57) ABSTRACT

An apparatus for loading rewind cores onto a winding mandrel (3) of a web winding machine comprises a first conveyor for conveying each of a plurality of rewind cores from a hopper or store to a loading position immediately adjacent to and coaxial with the free end of the said winding mandrel and a second conveyor (7,8) adapted to engage with a rewind core at the said loading position and to convey said rewind core over the free end of the winding mandrel (3) and along the length thereof to a predetermined position.

20 Claims, 1 Drawing Sheet

CORE POSITIONING APPARATUS

BACKGROUND OF THE INVENTION

The present invention relates to an apparatus for automatically positioning one or more cylindrical cores onto the winding mandrels of a web winding machine, prior to winding a web of material onto each core.

It is known to wind material from a primary roll onto a disposal or rewind core mounted on a winding mandrel with a view to forming a secondary roll (rewind core plus material) of a manageable size. When the secondary roll achieves a predetermined diameter the connection with the primary roll is severed and the secondary roll is removed from the winding mandrel. In order to provide for continuous operation of the web winding machine it is known to provide three or more winding mandrels on a rotatable turret, each of which is equidistantly spaced from its immediate neighbours. As the turret rotates each mandrel in turn passes through respective positions for receiving a rewind core, winding the web of material thereon, severing the connection with the primary roll and removal of the finished secondary roll. In these known machines a human operative places the rewind core onto each mandrel as it arrives at the rewind core receiving position and, likewise, removes the finished secondary roll.

Whilst web winding machines have been described above with reference to a single secondary roll being wound on each winding mandrel in turn, it is more usual for two or more secondary rolls to be wound at a time. Where this occurs accurate positioning and spacing of the rewind cores along the winding mandrel is very important. If the operative fails to position and space the rewind cores accurately on the winding mandrel the webs of material on adjacent secondary rolls may overlap and interleave with each other during winding. Should this occur the secondary rolls must usually be scrapped.

Even assuming that the secondary rolls can be satisfactorily wound on the winding mandrel, problems can arise for the operative between loading the rewind cores and removing them. In this regard, the operative only has a short period of time to remove the completed secondary rolls from a mandrel and then to load that mandrel with the required number of rewind cores. If he fails to act within his period the continuous operation of the machine is interrupted. The smaller the diameter of the finished secondary rolls the shorter the period available to the operative loading each mandrel in turn with rewind cores.

In order to facilitate attachment of the free end of each primary roll to a respective rewind core, the web winding machine may comprise an adhesive applicator which applies a bead of adhesive to each end of each rewind core mounted on the winding mandrel. It will be apparent that where the rewind cores are not accurately positioned on the winding mandrel, these beads of adhesive will be applied to the wrong part of the rewind cores or even onto the winding mandrel itself.

BRIEF SUMMARY OF THE INVENTION

It is an object of the present invention to provide an apparatus for placing rewind cores onto the winding mandrels of a web winding machine.

It is yet another object of the present invention to provide an apparatus for placing the or each rewind core at a predetermined position on the winding mandrel.

It is yet a further object of the present invention to provide an apparatus for automatically loading rewind cores in a web winding machine, thus obviating the need for human intervention.

According to the present invention there is provided an apparatus for loading rewind cores onto a winding mandrel of a web winding machine, the apparatus comprising first conveyor means for conveying each of a plurality of rewind cores from a hopper or store to a loading position immediately adjacent to and coaxial with the free end of the said winding mandrel and second conveyor means adapted to engage with a rewind core at the said loading position and to convey said rewind core over the free end of the winding mandrel and along the length thereof to a predetermined position.

The second conveyor means is moveable in a linear manner the length of the winding mandrel. In this regard, it may comprise a reciprocating carriage which picks up and transports each rewind core in turn to the required position along the length of the winding mandrel, returning to the said loading position after each rewind core has been placed to pick up a new rewind core. However, in a preferred embodiment of the present invention the second conveyor means comprises a continuous conveyor extending the length of the rewind mandrel. Preferably, the continuous conveyor comprises a continuous belt. However, it will be understood that the present invention is not limited to this. For example, an alternative form of continuous conveyor might comprise driven rollers.

In operation, when a first rewind core to be placed on the winding mandrel arrives at the said loading position it is picked up by the continuous conveyor and conveyed a predetermined distance along the winding mandrel. At this point the next rewind core arrives at the loading position. Now when the continuous conveyor is operated it conveys both the first and the second rewind cores together a predetermined distance along the winding mandrel. This process is repeated until the required number of rewind cores have been positioned on the winding mandrel. Each time another rewind core is positioned on the winding mandrel, the previously positioned rewind cores are moved along by the same distance. It will be appreciated that by careful programming of the continuous conveyor it is possible to ensure that the required positioning and spacing of the rewind cores on the winding mandrel is achieved.

Preferably, the apparatus comprises a pair of continuous conveyors, each positioned diametrically opposite the other about the winding mandrel and extending parallel to the longitudinal axis thereof. In this embodiment of the invention, each rewind core is picked up between the two conveyors to be carried onto the winding mandrel. Conveniently, the spacing between the two continuous conveyors is adjustable to accommodate different diameter rewind cores.

However, it will be understood that the apparatus may comprise just one conveyor in engagement with the rewind mandrel itself so as to convey each rewind roll onto the winding mandrel between itself and the winding mandrel.

Conveniently, the said second conveyor means is mounted on a retractable support which allows it to be moved into and out of the path of each winding mandrel as it is rotated into the rewind core loading position adjacent the said first conveyor means. In this regard, operation of the retractable support is synchronised with the web winding machine such that each time the web winding machine operates to bring a winding mandrel into the rewind core loading position, the second conveyor is removed from the path thereof and when the winding mandrel reaches the rewind core loading position it is engaged therewith. This ensures that the second conveyor means does not impede the movement of the winding mandrels. Conveniently, the retractable support and the second conveyor means is mounted in the floor of the web winding machine.

BRIEF DESCRIPTION OF THE DRAWING

An embodiment of the present invention will now be described, by way of example, with reference to the accompanying drawing, which shows a schematic view of web winding machine fitted with a core positioning apparatus in accordance with the present invention.

DETAILED DESCRIPTION OF THE INVENTION

Figure 1:
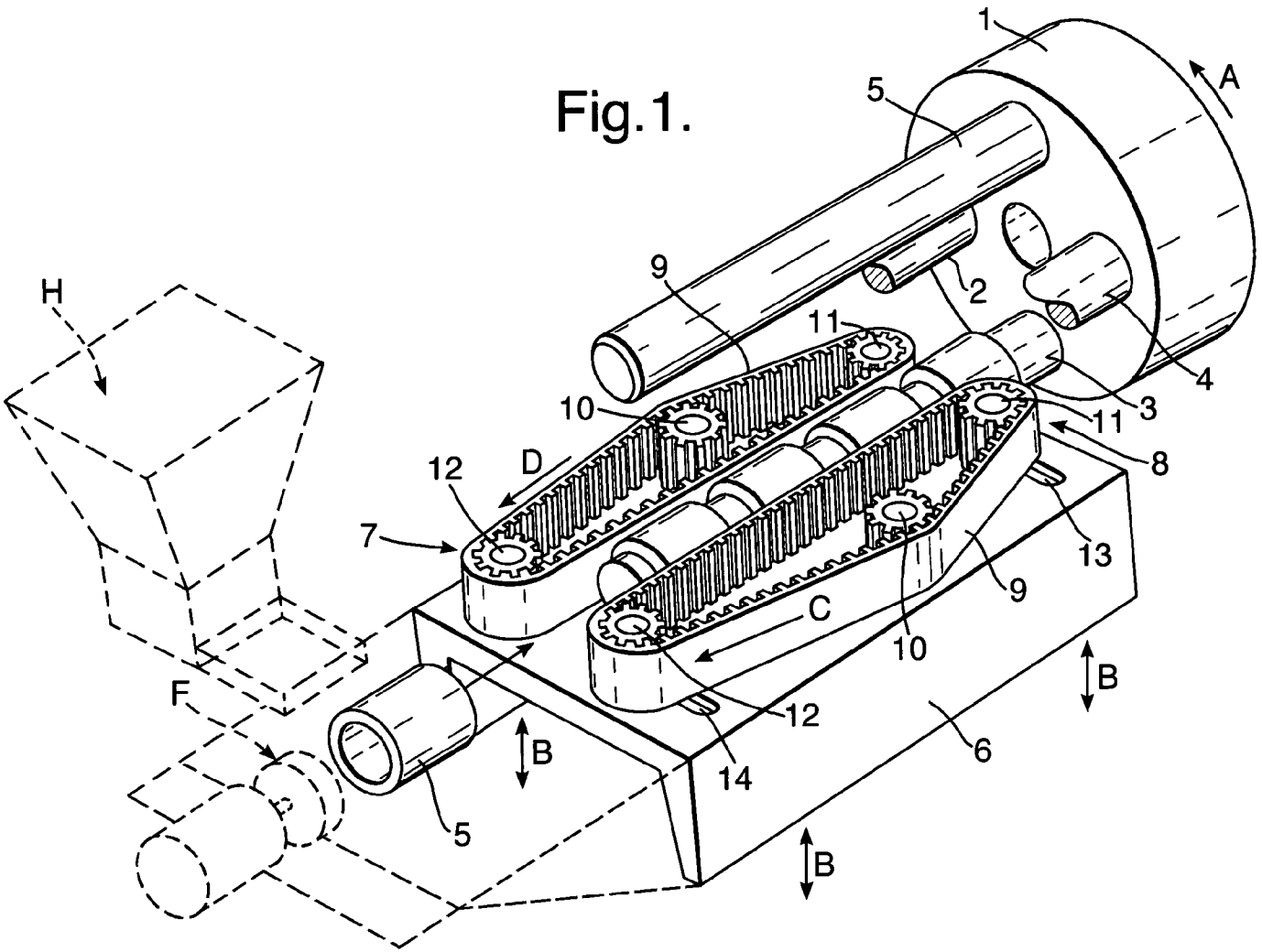

Referring to the drawing there is shown the turret mechanism 1 of a web winding machine (which is not otherwise shown for ease of illustration). comprising four winding mandrels 2, 3, 4 and 5. The turret 1 is rotatable in the direction of arrow A to bring each winding mandrel in turn into a rewind core receiving position. As shown in the drawing, this position is occupied by winding mandrel 3.

To the immediate left of the free end of the winding mandrel 3 is positioned a first conveyor F which conveys rewind cores from a hopper H to a loading position. The conveyor F ensures that on reaching this loading position each rewind core 5 in turn is aligned coaxially with the winding mandrel 3.

A support platform 6 is positioned immediately beneath the winding mandrel 3 occupying the rewind core receiving position. This platform is moveable up and down in the direction of arrows B, towards and away from the winding mandrel 3. On its upper surface the platform 6 supports a pair of continuous conveyors 7 and 8, each of which consists of a continuous toothed belt 9, a drive roller 10 and a pair of guide rollers 11 and 12. The two continuous conveyors 7 and 8 travel at the same speed, but rotate in opposite directions with respect to one another as illustrated by arrows C and D. Independent drive motors may be provided for each continuous conveyor, but more conveniently a single drive motor is provided which is linked to each drive roller. The drive motor is conveniently mounted under the support platform 6. The support spindles (not shown) for each of guide rollers 11 and 12 extend through elongate slots 13 and 14 in the upper surface of the support platform 6 and are adjustable towards and away from the centre line thereof to vary the spacing between the facing surfaces of the two continuous toothed belts 9.

In operation, the support platform 6 is synchronised with the rotation of the turret 1 such that as it rotates to bring an empty winding mandrel into the rewind core receiving position, it lies beneath and out of the path thereof. When the empty winding mandrel has arrived at the rewind core receiving position the support platform 6 is raised so as to position the two continuous conveyors 7 and 8 on either side thereof. It will be seen in the accompanying drawing that the two facing surfaces of the continuous toothed belts 9 extend parallel with the longitudinal axis of the winding mandrel 3 and slightly beyond the free end thereof to engage with the rewind core 5 occupying the loading position. At this point the guide rollers 11 and 12 at the ends of each continuous toothed belts 9 are moved towards each other to bring the facing surfaces of the continuous tooth belts 9 into contact with the rewind core 5.

Now as the two continuous conveyors 7 and 8 are driven, the rewind core 5 occupying the loading position is picked up and transported between the facing surfaces thereof over the free end of the winding mandrel 3 and to a predetermined position along its length. At this point the two continuous conveyors 7 and 8 halt and a further rewind core 5 is conveyed to the loading position. Now, when the two continuous conveyors 7 and 8 are driven both the rewind core 5 already on the winding mandrel 3 and the newly arrived rewind core 5 are transported along the winding mandrel 3 by the same distance. This process is repeated for each and every subsequent rewind core 5 to be positioned on the winding mandrel 3. It will be understood that by appropriate programming of the operation of the drive means to the continuous conveyors 7 and 8, each and every rewind core 5 can be transported to a predetermined position along the length of the winding mandrel 5. This process is entirely automatic and needs no human intervention, other than the initial setting of the positions.

It will be understood that different diameter rewind cores can be accommodated by adjusting the spacing between the facing surfaces of the continuous conveyors 7 and 8.

What is claimed is:

1. An apparatus for loading a plurality of rewind cores onto a winding mandrel of a web winding machine, the apparatus comprising first conveyor means for conveying the rewind cores one at a time from a hopper to a loading position immediately adjacent to and coaxial with a free end of said winding mandrel and second conveyor means disposed adjacent to said winding mandrel and movable during a rewind core loading operation along a path parallel to a longitudinal axis of the winding mandrel to convey each rewind core in turn from the loading position over the free end of the winding mandrel and along the length thereof to a respective predetermined position, wherein, for each rewind core loading operation, said second conveyor means removes only one rewind core at a time from said loading position.

2. An apparatus according to claim 1, wherein said second conveyor means comprises a carriage adapted to engage with a rewind core at the loading position and capable of reciprocating motion along said path parallel to the longitudinal axis of said winding mandrel to transfer said rewind core to a predetermined position along the length of said winding mandrel and then to return to said loading position for the next rewind core.

3. An apparatus according to claim 1, wherein said second conveyor means comprises a continuous conveyor defining a conveyor surface extending parallel to the longitudinal axis of said winding mandrel.

4. An apparatus according to claim 3, wherein the continuous conveyor is operated intermittently to advance a first rewind core at the loading position along the winding mandrel by a predetermined distance and subsequently to advance a next rewind core at the loading position together with the first rewind core already on the winding mandrel by a predetermined distance along its length.

5. An apparatus according to claim 4, wherein the continuous conveyor comprises a continuous belt (9).

6. An apparatus according to claim 5, wherein the continuous conveyor comprises driven rollers.

7. An apparatus according to claim 4, wherein said second conveyor means comprises a pair of continuous conveyors (9), each positioned diametrically opposite the other about the winding mandrel and extending parallel to the longitudinal axis thereof and adapted to convey each rewind core therebetween to carry same onto the winding mandrel.

8. An apparatus according to claim 7, wherein the spacing between the two continuous conveyors (9) is adjustable to accommodate different diameter rewind cores.

9. An apparatus according to claim 1, wherein the said second conveyor means (7,8) is mounted on a retractable support (6) which allows it to be moved into and out of the path of the winding mandrel as it is moved into the rewind core loading position adjacent said first conveyor means.

10. An apparatus according to claim 9, wherein operation of the retractable support (6) is synchronised with the web winding machine such that each time the web winding machine operates to bring the winding mandrel into the rewind core loading position, the second conveyor (7,8) is removed from the path thereof and when the winding mandrel reaches the rewind core loading position it is engaged therewith.

11. An apparatus according to claim 5, wherein said second conveyor means comprises a pair of continuous conveyors (9), each positioned diametrically opposite the other about the winding mandrel and extending parallel to the longitudinal axis thereof and adapted to convey each rewind core therebetween to carry same onto the winding mandrel.

12. An apparatus according to claim 6, wherein said second conveyor means comprises a pair of continuous conveyors (9), each positioned diametrically opposite the other about the winding mandrel and extending parallel to the longitudinal axis thereof and adapted to convey each rewind core therebetween to carry same onto the winding mandrel.

13. An apparatus according to claim 2, wherein the said second conveyor means (7,8) is mounted on a retractable support (6) which allows it to be moved into and out of the path of the winding mandrel as it is moved into the rewind core loading position adjacent said first conveyor means.

14. An apparatus according to claim 3, wherein the said second conveyor means (7,8) is mounted on a retractable support (6) which allows it to be moved into and out of the path of the winding mandrel as it is moved into the rewind core loading position adjacent said first conveyor means.

15. An apparatus according to claim 4, wherein the said second conveyor means (7,8) is mounted on a retractable support (6) which allows it to be moved into and out of the path of the winding mandrel as it is moved into the rewind core loading position adjacent said first conveyor means.

16. An apparatus according to claim 5, wherein the said second conveyor means (7,8) is mounted on a retractable support (6) which allows it to be moved into and out of the path of the winding mandrel as it is moved into the rewind core loading position adjacent said first conveyor means.

17. An apparatus according to claim 6, wherein the said second conveyor means (7,8) is mounted on a retractable support (6) which allows it to be moved into and out of the path of the winding mandrel as it is moved into the rewind core loading position adjacent said first conveyor means.

18. An apparatus according to claim 7, wherein the said second conveyor means (7,8)is mounted on a retractable support (6) which allows it to be moved into and out of the path of the winding mandrel as it is moved into the rewind core loading position adjacent said first conveyor means.

19. An apparatus according to claim 8, wherein the said second conveyor means (7,8) is mounted on a retractable support (6) which allows it to be moved into and out of the path of the winding mandrel as it is moved into the rewind core loading position adjacent said first conveyor means.

20. An apparatus comprising:

a mandrel having a free end;

a first conveyor that moves associated rewind cores to a loading position adjacent to and coaxial with the free end of said mandrel, wherein only a single rewind core at a time is located in said loading position;

a second conveyor for engaging and moving a single rewind core from the loading position over the free end and onto the mandrel during a core loading operation, wherein during said core loading operation, said second conveyor also engages and moves at least one previously loaded rewind core already loaded on said mandrel together with the single rewind core so that when said single rewind core is moved from said loading position onto said mandrel, said at least one previously loaded rewind core is shifted on said mandrel by said second conveyor.

* * * * *